US006722424B2

(12) United States Patent
Broad

(10) Patent No.: US 6,722,424 B2
(45) Date of Patent: Apr. 20, 2004

(54) HYDRAULIC FIRING HEAD

(75) Inventor: Ross Broad, Red Deer (CA)

(73) Assignee: Innicor Subsurface Technoloiges, Inc., Calgary (CA)

( * ) Notice: Subject to any disclaimer, the term of this patent is extended or adjusted under 35 U.S.C. 154(b) by 0 days.

(21) Appl. No.: 09/964,896

(22) Filed: Sep. 28, 2001

(65) Prior Publication Data

US 2003/0062153 A1 Apr. 3, 2003

(51) Int. Cl.[7] ..... E21B 29/02
(52) U.S. Cl. ..... 166/55.1; 166/297; 166/332.4
(58) Field of Search ..... 166/297, 55.1, 166/55, 317, 318, 332.4, 373, 386, 239; 175/4.56; 89/1.15

(56) References Cited

U.S. PATENT DOCUMENTS

| | | | | |
|---|---|---|---|---|
| 4,330,039 A | | 5/1982 | Vann et al. | |
| 4,434,854 A | | 3/1984 | Vann et al. | |
| 4,512,406 A | | 4/1985 | Vann et al. | |
| 4,515,217 A | | 5/1985 | Stout | |
| 4,576,233 A | | 3/1986 | George | |
| 4,800,958 A | | 1/1989 | Haugen et al. | |
| 5,174,379 A | * | 12/1992 | Whiteley et al. | 166/278 |
| 5,429,192 A | * | 7/1995 | Huber et al. | 166/297 |
| 5,462,117 A | | 10/1995 | Green et al. | |
| 5,482,119 A | * | 1/1996 | Manke et al. | 166/374 |
| 6,053,248 A | * | 4/2000 | Ross | 166/297 |
| 6,085,843 A | | 7/2000 | Edwards et al. | |

OTHER PUBLICATIONS

Brochure Prime Performing Systems Ltd. "Autovent Pressure Firing Assembly" not dated.

Brochure Jet Research Center "Model KV11 Series Firing Head" Jun. 1999.

Brochure Oven Oil Tools "Direct Pressure Vent Firing Head" 2000.

* cited by examiner

*Primary Examiner*—David Bagnell
*Assistant Examiner*—Daniel P Stephenson
(74) *Attorney, Agent, or Firm*—Bennett Jones LLP

(57) ABSTRACT

A downhole tool hydraulic firing head includes an automatic drain that is opened when the piston is driven to fire. The automatic drain includes a vent opening from the bore and a sleeve disposed within the bore to move axially with the piston. The sleeve is moveable from a position covering the vent opening to a position clear of the vent opening. A locking collet is disposed between the sleeve and the housing, which locks the sleeve into the position, clear of the vent opening, when the sleeve is moved into that position. This locks the sleeve against returning to the position covering the vent opening when it is urged to move in that direction such as, for example, by venturi forces of the evacuating fluid or by pressure generated from the explosive charges. The firing head is useful to detonate downhole explosive charges, such as those in a perforating gun.

18 Claims, 3 Drawing Sheets

Figure 1
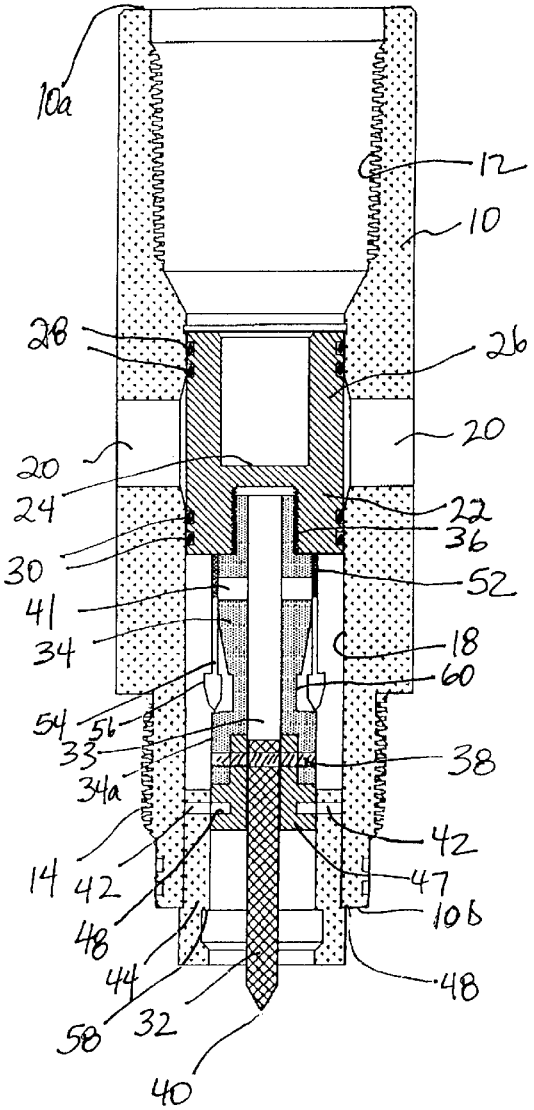
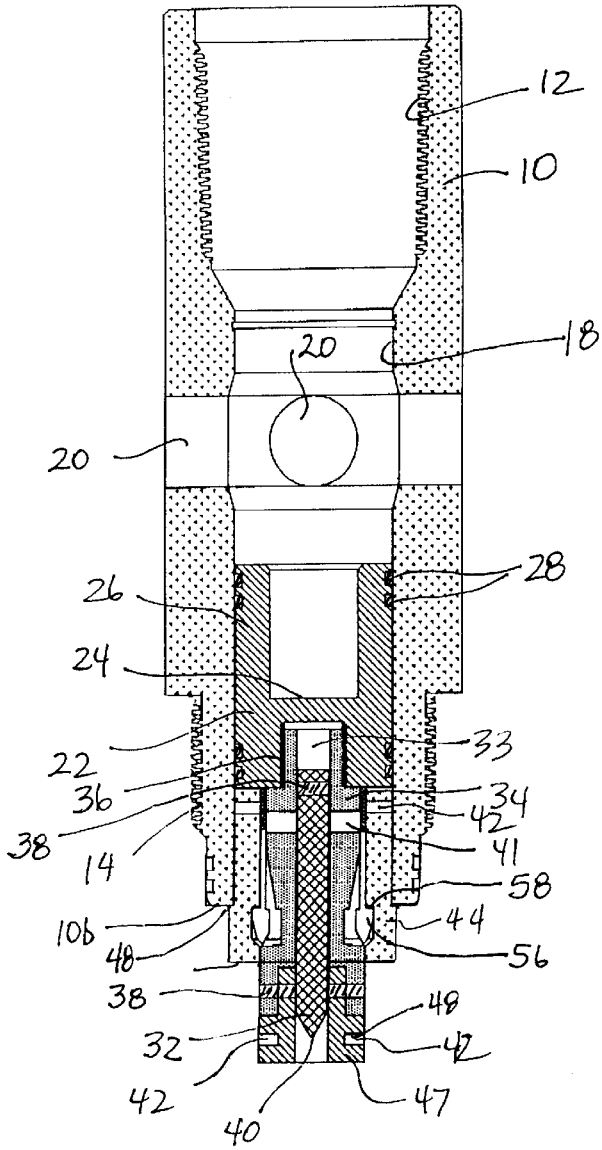
Figure 2

HYDRAULIC FIRING HEAD

FIELD OF THE INVENTION

The invention relates to well bore explosive detonation tools and, in particular, to a hydraulic firing head for a downhole tool.

BACKGROUND OF THE INVENTION

In subterranean well bores, firing heads are used to detonate downhole explosives. Explosives are used downhole in various tools including packers and perforating gun assemblies. In these tools, the firing head is driven to actuate an initiator to detonate explosive charges in the tool.

One type of firing head is driven hydraulically. These hydraulic firing heads are generally conveyed on a tubing string and controlled by fluid pressure applied through a fluid column in the tubing string. The fluid can be a liquid or gas for example, compressed nitrogen or water. Pressure is applied from surface through the fluid column in the tubing string above the firing head, acting on a piston and attached assembly, which is secured by a number of shear pins. The shear pins are selected and built to shear at a known load. The number of shear pins used to secure the piston determines the pressure at which the head fires. Shearing the pins by applied pressure, drives a firing pin attached to the piston to strike the initiator, which transfers an explosive charge to the detonator in association with the main explosives of the tool.

Once the explosives are detonated, it is sometimes useful to drain the hydraulic fluid from the tubing string, prior to tripping the tubing to surface. For this purpose, vents closed by sliding sleeves have been installed in the tubing string and in the firing head. However when vents have been included in the firing head, the pressures generated by evacuating fluid or gun detonation pressure tend to drive the piston to close the vents prior to complete draining of the tubing string. Snap rings have been used to lock the piston in a position away from vents. However, hydraulic firing heads often fail to allow complete draining of the tubing string.

SUMMARY OF THE INVENTION

A downhole tool hydraulic firing head has been invented that includes an automatic drain including vents, the opening of which is controlled by movement of the piston. A locking collet in the firing head holds the piston down after firing, ensuring that venturi action or gun detonation pressure acting on the piston does not close off the vents.

In accordance with a broad aspect of the present invention, there is provided a downhole tool hydraulic firing head comprising: a housing connectable into a tubing string and having a bore extending therethrough from its upper end to its lower end; a vent opening extending through a side wall of the housing, the vent opening being open to the bore; a piston in the bore, the piston being drivable by fluid pressure applied though the bore; a firing pin for activating detonation of an explosive charge, the firing pin connected to the piston to move with the piston; a sleeve on the piston and moveable therewith from a position covering the vent opening to a position clear of the vent opening; and a locking collet including a plurality of collet fingers with engaging lugs acting between the sleeve and the housing to lock the sleeve into the position where it is clear of the vent opening.

The housing can be formed of one part or multiple interconnected parts, as desired. Manufacture, assembly and repair can be facilitated by forming the housing of multiple interconnected parts. The piston, sleeve, firing pin can be formed integral with each other or of separate parts secured to move together. Again, the use of separate secured parts can facilitate manufacture, assembly and repair.

The sleeve can be the sidewall of the piston or a cylindrical extension of the piston. Preferably sealing means, such as O-rings are provided on the sleeve to seal against fluid passage through the vent opening when the sleeve is in position covering the vent opening.

The locking collet is disposed to act between the sleeve and the housing and engages a shoulder. The locking collet and shoulder can be disposed directly on these parts or can be disposed on other parts secured to the housing and the sleeve. The collet can be connected to move with the sleeve, while the shoulder is formed in the housing or, alternately, the collet can be secured to the housing, while the shoulder is in association with the sleeve.

In one embodiment, the locking collet is secured to the sleeve. Alternately, the locking collet can be secured to the piston or the firing pin, since both the sleeve and the firing pin move with the piston. Alternately the locking collet can be secured to another part, connected to at least one of the firing pin, the piston or the sleeve. Likewise, the shoulder can be formed directly on the housing or on parts secured within the housing.

The piston can be releasably secured against movement unless a selected amount of fluid pressure is applied to the piston. In one embodiment, a shear pin is used to releasably secure the piston in this way.

BRIEF DESCRIPTION OF THE DRAWINGS

The invention will now be described, by way of example only, reference being made to the accompanying drawings in which:

FIG. 1 is a vertical section of a hydraulic firing head according to the present invention in the run in position;

FIG. 2 is a vertical section of the firing head of FIG. 1 with the collet locked under the collet shoulder;

DETAILED DESCRIPTION OF THE PREFERRED EMBODIMENTS

Figure 3:
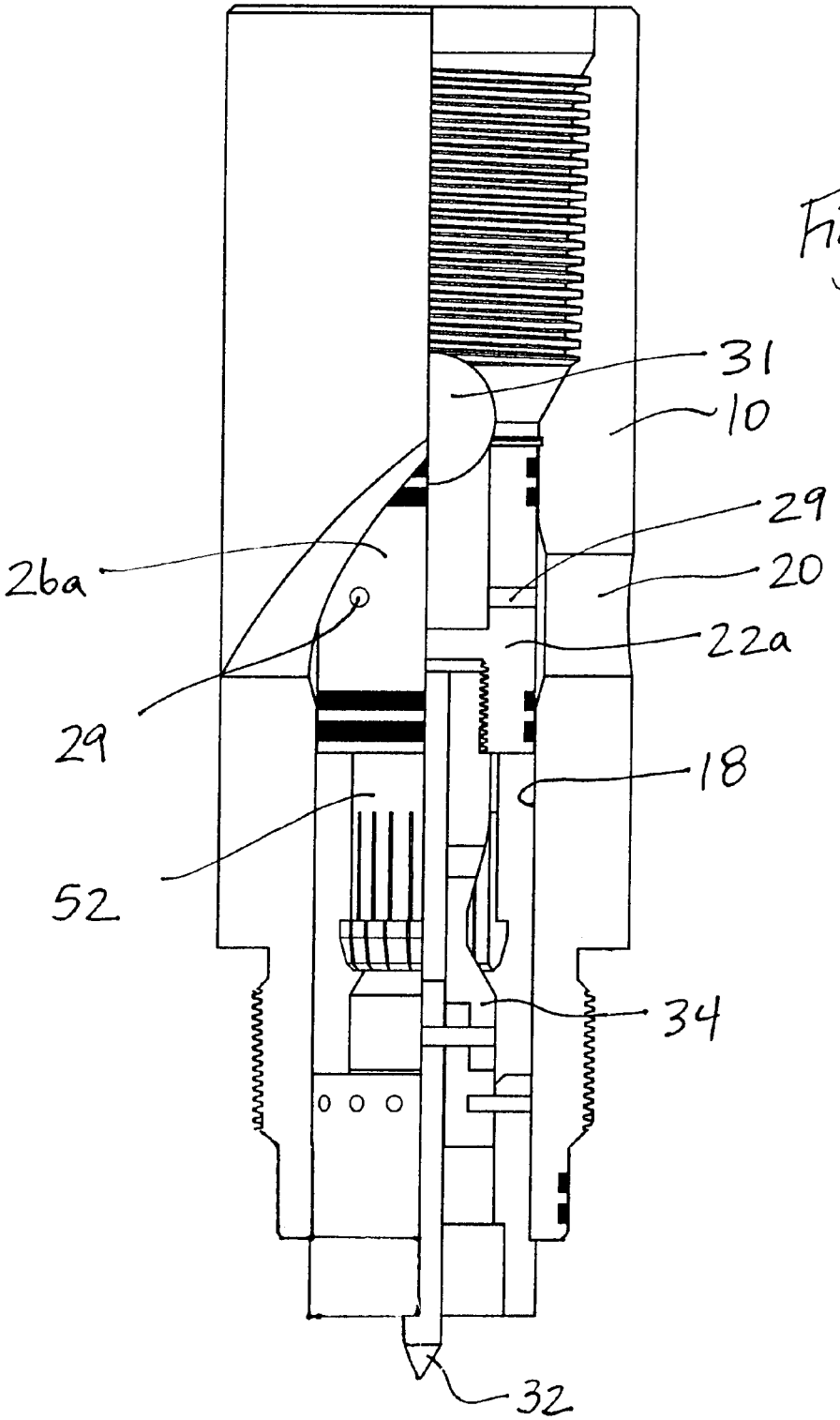
FIG. 3 is a vertical quarter section of a hydraulic firing head according to the present invention through which it is possible to circulate hydraulic fluid prior to driving the piston. The firing head is shown with the piston in the run in position, but with a ball seated therein in preparation for driving the piston to detonate the initiator.

Referring to FIGS. 1 and 2, there is shown a downhole tool hydraulic firing head according to one aspect of the present invention. The firing head can be used in any downhole tool where it is desired to initiate an explosive charge by applying pressure to the firing head. The downhole tool can be, for example, a perforating gun assembly or a packer assembly. The firing head includes a tubular housing 10 including upper threads 12 for connection to a tubing string (not shown). Lower threads 14 provide for connection to the remainder of the downhole tool or the tubing string, such as the initiator sub 16 shown in FIG. 4, which will be described in greater detail hereinbelow.

Tubular housing 10 includes an inner bore 18 extending from the housing upper end 10*a* to the housing lower end

10*b*. Vent openings 20 extend from inner bore 18 to the housing outer surface. While three vent openings are shown, one or more vent openings can be provided about the circumference of the housing. In one embodiment, four vent openings are spaced about the circumference of the housing.

A piston 22 is slidably disposed in bore 18 and is mounted to allow for axial movement in the bore in response to fluid pressure applied from the tubing string connected at the upper end 10*a* of the firing head. In particular, piston 22 is axially slidable between a run in position, shown in FIG. 1 and a firing position shown in FIG. 2. Piston 22 includes a face 24 against which the fluid pressure acts and a cylindrical sidewall 26 that closely fits within the bore. Sealing members 28 such as O-rings are mounted in glands on the cylindrical sidewall, creating a seal between bore 18 and piston 22 and ensuring that fluid pressure acts on the face 24 of the piston rather than bypassing the piston. As will be appreciated, the piston can assume forms other than the specific embodiment shown such as, for example, the piston body can be solid and/or the piston face can be disposed on the piston closer to its upper end.

The piston acts as a sleeve within the bore to control the opening of vent openings 20. In particular, cylindrical sidewall 26 is sized and configured to cover vent openings 20 when the piston is in the run in position (FIG. 1). Another arrangement of sealing members 30 seals between the bore and the piston below the vent openings, when the piston is disposed over the vent openings. As shown in FIG. 2, the piston can be moved such that the cylindrical sidewall is clear of the vent openings, thereby permitting fluid flow therethrough.

In some embodiments, as illustrated in FIG. 3, it is desirable to circulate fluid through the tubing string above piston 22*a* and the annulus about the tubing string, without driving the piston to move within bore 18. In such an embodiment, apertures 29 are formed through cylindrical sidewall 26*a* of the piston and positioned to be in fluid communication with vent openings 20 when the piston is in the run in position covering the vent openings. A circulating amount of fluid can pass through apertures 29 and out through the vent openings, without driving the piston to move within the bore. However, when it is desired to drive piston, a ball 31 is dropped from surface, which is sized to seat on piston 22*a* and create a seal therebetween. This seals against fluid flow through apertures 29 and when the pressure of hydraulic fluid the piston is increased, piston 22*a* with ball 31 seated thereon is driven down.

A firing pin 32 is rigidly connected to piston 22 for movement therewith. Firing pin 32 can be connected in any way, for example by forming integral with, welding to etc., the piston. In the illustrated embodiment, firing pin 32 is secured in a bore 33 in an insert 34 that threads via threaded connection 36 into the rod side of the piston. This arrangement facilitates assembly and repair of the firing head and replacement of the firing pin. Firing pin 32 can be secured in numerous ways to insert 34 such as, for example, by a pin 38 secured between insert 34 and firing pin 32, by weldments or threaded engagement. The pointed tip 40 of the firing pin extends out below the insert and into initiator sub 16. In the illustrated embodiment, firing pin 32 is collapsible (as shown in FIG. 2), wherein when the firing pin strikes the initiator, pin 38 shears and the firing pin moves up into the bore. A port 41 between bore 33 and the outer surface of the insert permits equalization of pressure and collapsing of the firing pin.

Figure 4:
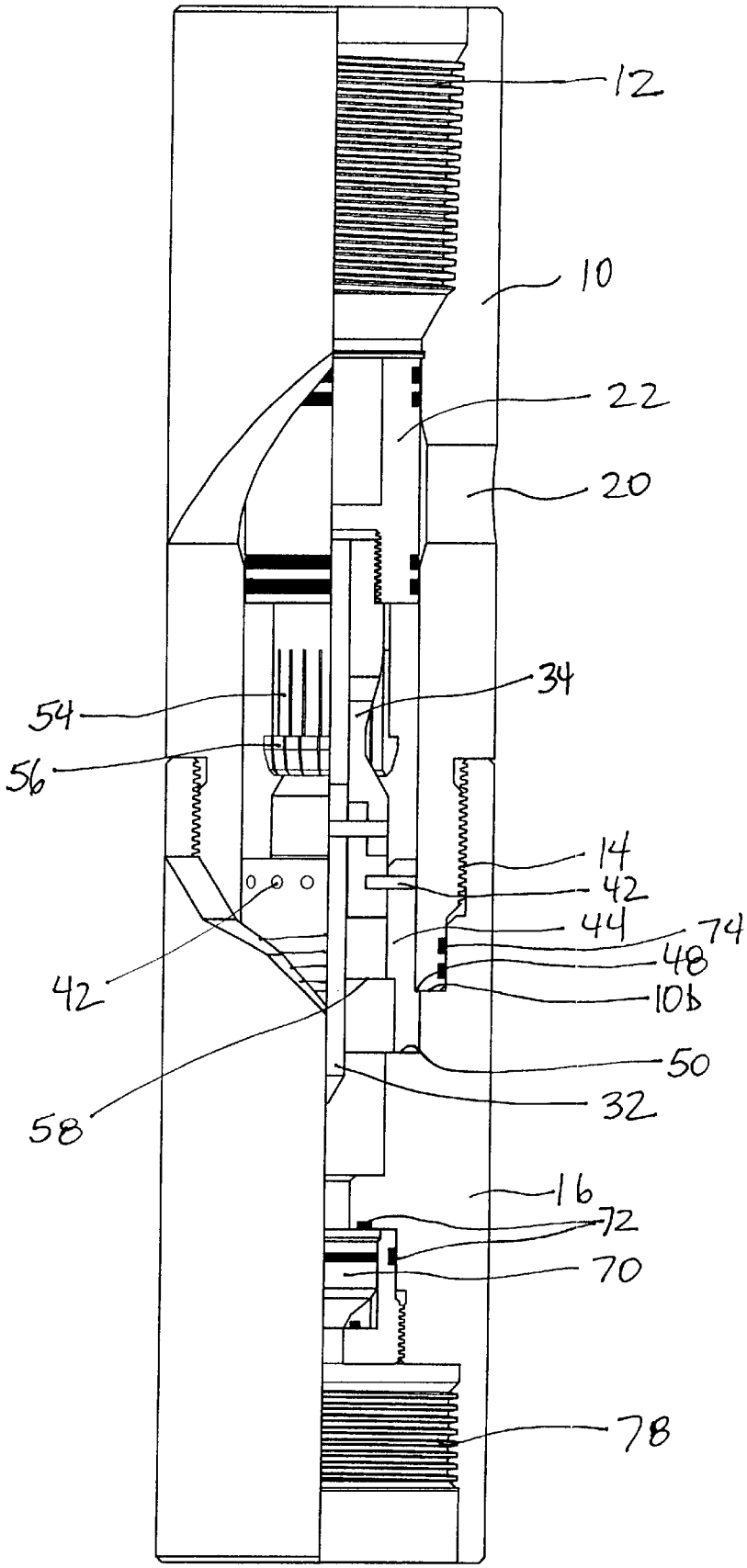
FIG. 4 is vertical quarter section of a hydraulic firing head according to the present invention with an initiator sub attached therebelow.

The piston is secured against axial movement in bore 18 by shear pins 42. As will be appreciated, the shear pins are selected to shear at a known load, thereby permitting the piston to move axially within the bore. While shear pins 42 act between bore 18 of the housing and the piston, in the illustrated embodiment, the shear pins are connected between a ring 47 on insert 34 and a shear pin collar 44 mounted in the bore. The shear pins at one end engage in an annular groove 48 of ring 47, which is secured by pin 38 to insert 34. Of course, insert 34 could be formed to accept the shear pins, but provision of a separate ring facilitates repair and reuse of the assembly. At their other end, pins 42 are located in holes in the shear pin collar. As best seen in FIG. 4, shear pin collar 44 is retained against axial movement by a shoulder 48 that abuts against lower end 10*b* of the housing and by abutting at its end against a shoulder 50 on the initiator sub.

A locking collet 52 is connected to insert 34 to move axially with piston 22. In particular, locking collet 52 is engaged on a reduced diameter section of insert 34 and retained against axial movement on the insert by abutment between piston 22 and an enlarged lower section 34*a* of the insert. Locking collet 52 includes a plurality of collet fingers 54 which terminate in collet lugs 56. Collet lugs 56 extend outwardly to be catchable under shoulder 58 on shear pin retaining collar 44. Insert 34 includes an annular tapered section 60 adjacent fingers 54 which permit the fingers to flex inwardly to pass retaining collar 44.

Piston 22, insert 34, ring 47, firing pin 32, locking collet 52 and shear pin collar 44 can be assembled with pin 38 and shear pins 42 outside of housing and inserted into the bore in assembled form. In the bore, the assembly is held in place by threading initiator sub 16 onto lower threads 14. This facilitates manufacture, assembly and repair of the firing head.

As noted hereinbefore, housing 10 is threaded to initiator sub 16. The initiator sub includes an initiator 70, which is detonated when firing pin 32 strikes thereagainst.

Numerous seals, for example, O-rings 72, 74 are provided to effect a fluid tight seal below the piston. Threads 78 on the lower end of the initiator sub are connectable to the remainder of the downhole tool such as, for example, the perforating guns.

Operation

The downhole tool hydraulic firing head of the present invention is assembled by connecting firing pin 32, ring 47 and locking collet 52 to, insert 34. The insert is then threaded into piston 22 and sealing members 28 and 30 are installed into the glands on the piston. Shear pin collar 44 is slid onto the ring and shear pins 42 are inserted through holes in the collar to extend into groove 46 about the ring. The number of shear pins is selected depending on the shear load of the shear pins used and the hydraulic pressure at which it is desired to drive the piston.

The assembly of the piston, firing pin and collar 44 is then inserted into bore 18 of housing 10. The assembly is introduced to the lower end of the housing until shoulder 48 butts against the housing. Initiator sub 16 is then threaded onto lower end 10*b* so that collar 44 is held against axial movement in the tool.

The firing head and initiator sub are then connected through threads 12 to a tubing string having a bore in fluid communication with the upper portion of bore 18. A lower string including the explosive charges to be detonated (not shown) is connected to threads 78 of initiator sub 16. The explosive charges can be, for example, contained in a perforating gun.

The hydraulic firing head and attached strings are then run in to a selected position wherein it is desired to detonate the explosive charges. When the hydraulic firing head is incorporated into a perforating gun assembly, the strings and perforating gun assembly are run in until the guns are adjacent the position where it is desirable to perforate the casing.

In the run in position, shear pins 42 secure piston such that cylindrical sidewall 26 covers vent openings 20 and seals against fluid flow therethrough. In addition, firing pin 32 is spaced above but aligned for entry into initiator 70.

When the downhole tool is in position, fluid is introduced from surface to the tubing string and, thereby to bore 18, until the pressure against face 24 exceeds the holding capacity of shear pins 42.

In the embodiment of FIG. 3 wherein the sleeve has apertures 29 therein for circulation of fluid therethrough, when the downhole tool is in position, ball 31 is dropped to seat on piston 22*a*. Then fluid is introduced to the tubing string until the pressure against the ball exceeds the holding capacity of the shear pins.

When pins 42 shear, piston 22 is driven down such that firing pin 32 is driven to detonate the initiator and, thereby, detonate the explosives. The firing pin can collapse into bore 33 of the insert, if it is of the collapsible-type.

At the same time, the cylindrical sidewall moves clear of the vent openings, permitting fluid from the tubing string to drain therethrough. As piston moves down, collet fingers ride over shear pin collar 44 and flex inwardly into tapered section 60. Once lugs 56 pass shoulder 58 of collar 44, they flex out and catch under the shoulder. The engagement between lugs 56 and shoulder 58 is such that venturi action, caused by fluid evacuation through the vent openings, or detonation pressure from below piston is unable to disengage the collet lugs from under shoulder 58 and thus, the piston remains down clear of the vent openings.

It will be apparent that many other changes may be made to the illustrative embodiments, while falling within the scope of the invention and it is intended that all such changes be covered by the claims appended hereto.

What is claimed is:

1. A downhole tool hydraulic firing head comprising: a housing connectable into a tubing string and having a bore extending therethrough from its upper end to its lower end; a vent opening extending through a side wall of the housing, the vent opening being open to the bore; a piston in the bore, the piston being drivable by fluid pressure applied though the bore; a firing pin for activating detonation of explosives, the firing pin connected to the piston to move with the piston; a sleeve on the piston and moveable therewith from a position covering the vent opening to a position clear of the vent opening; and a collet including a plurality of collet fingers with collet lugs extending therefrom acting between the sleeve and the housing to engage a shoulder, formed as a part of a ring mounted within the bore, and lock the sleeve into the position where it is clear of the vent opening.

2. The downhole tool hydraulic firing head of claim 1 wherein the sleeve is formed integral with the piston.

3. The downhole tool hydraulic firing head of claim 1 wherein the sleeve is a sidewall of the piston.

4. The downhole tool hydraulic firing head of claim 1 wherein the looking collet is connected to an insert attached to the piston.

5. The downhole tool hydraulic firing head of claim 1 wherein the shoulder is formed within the bore.

6. The downhole tool hydraulic firing head of claim 1 wherein the piston is releasably secured against axial movement in the bore unless a selected amount of fluid pressure is applied to the piston.

7. The downhole tool hydraulic firing head of claim 6 wherein the piston is releasably secured by a shear pin acting between the housing and the piston.

8. A downhole tool hydraulic firing head comprising: a housing connectable into a tubing string and having a bore extending therethrough from its upper end to its lower end; a vent opening extending through a side wall of the housing, the vent opening being open to the bore; a piston in the bore, the piston being drivable by fluid pressure applied though the bore; a firing pin for activating detonation of explosives, the firing pin connected to the piston to move with the piston; a sleeve on the piston and moveable therewith from a position covering the vent opening to a position clear of the vent opening; a shoulder formed as a part of a ring mounted within the bore; and a collet including a plurality of collet fingers with collet lugs extending therefrom acting between the sleeve and the housing to engage the shoulder and lock the sleeve into the position where it is clear of the vent opening.

9. The downhole hydraulic firing head of claim 8 wherein the firing pin is collapsible by application of force thereto.

10. The downhole hydraulic firing head of claim 7 wherein the locking collet is connected to an insert attached to the piston.

11. The downhole hydraulic firing head of claim 10 wherein the insert includes a bore and the firing pin is mounted in the bore.

12. The downhole hydraulic firing head of claim 11 further comprising a shear pin for securing the firing pin into the insert bore, the pin being shearable to permit collapsing of the firing pin into the insert bore.

13. A downhole tool hydraulic firing head comprising: a housing connectable into a tubing string and having a bore extending therethrough from its upper end to its lower end; a vent opening extending through a side wall of the housing, the vent opening being open to the bore; a piston in the bore, the piston being drivable by fluid pressure applied through the bore; a firing pin for activating detonation of explosives a sleeve on the piston and moveable therewith from a position covering the vent opening to a position clear of the vent opening; an insert connected to the piston to move with the piston, the insert including a bore in which the firing pin is mounted for movement with the piston; and a collet including a plurality of collet fingers with collet lugs extending therefrom connected to the insert and acting between the piston and the housing to engage a shoulder and lock the piston into the position where the sleeve is clear of the vent opening.

14. The downhole hydraulic firing head of claim 13 further comprising a shear pin for securing the firing pin into the insert bore, the pin being shearable to permit collapsing of the firing pin into the insert bore.

15. The downhole tool hydraulic firing head of claim 13 wherein the shoulder is formed as a part of a ring mounted within the bore.

16. A downhole tool hydraulic firing head comprising: a housing connectable into a tubing string and having a bore extending therethrough from its upper end to its lower end; a vent opening extending through a side wall of the housing, the vent opening being open to the bore; a piston in the bore, the piston being drivable by fluid pressure applied though the bore; a firing pin for activating detonation of explosives, firing pin being collapsible from a striking position to a collapsed position; a sleeve en the piston and moveable therewith from a position covering the vent opening to a position clear of the vent opening; an insert connected to the piston to move with the piston, the insert including a bore in which the firing pin is mounted for movement with the piston; and a collet including a plurality of collet fingers with collet lugs extending therefrom connected to the insert and acting between the piston and the housing to engage a shoulder and lock the piston into the position where the sleeve is clear of the vent opening.

17. The downhole hydraulic firing head of claim 16 further comprising a firing pin bore in which the firing pin is mounted and is collapsible therein.

18. The downhole hydraulic firing head of claim 16 further comprising a shear pin for securing the firing pin into the insert bore, the pin being shearable to permit collapsing of the firing pin into the bore.

* * * * *